US011199104B2

(12) United States Patent
Barak et al.

(10) Patent No.: US 11,199,104 B2
(45) Date of Patent: Dec. 14, 2021

(54) SEAL ANTI-ROTATION

(71) Applicant: Raytheon Technologies Corporation, Farmington, CT (US)

(72) Inventors: Daniel Barak, Jupiter, FL (US); Joseph F. Englehart, Gastonia, NC (US)

(73) Assignee: Raytheon Technologies Corporation, Farmington, CT (US)

( * ) Notice: Subject to any disclaimer, the term of this patent is extended or adjusted under 35 U.S.C. 154(b) by 432 days.

(21) Appl. No.: 15/841,792

(22) Filed: Dec. 14, 2017

(65) Prior Publication Data

US 2019/0024525 A1 Jan. 24, 2019

Related U.S. Application Data

(60) Provisional application No. 62/506,339, filed on May 15, 2017.

(51) Int. Cl.

| | |
|---|---|
| ***F01D 11/08*** | (2006.01) |
| ***F01D 11/00*** | (2006.01) |
| ***F01D 25/24*** | (2006.01) |

(52) U.S. Cl.

CPC ..... *F01D 11/08* (2013.01); *F01D 11/005* (2013.01); *F01D 25/246* (2013.01); *F05D 2220/32* (2013.01); *F05D 2230/60* (2013.01); *F05D 2240/11* (2013.01); *F05D 2240/55* (2013.01); *F05D 2240/57* (2013.01); *F05D 2250/75* (2013.01)

(58) Field of Classification Search

CPC ..... F01D 11/003; F01D 11/08; F01D 11/005; F01D 25/243; F01D 25/246; F01D 25/28; F01D 9/044; F01D 5/066; F05D 2220/32; F05D 2230/60; F05D 2240/11; F05D 2240/55; F05D 2240/57; F05D 2240/75; F05D 2260/30

USPC ..... 415/173.1

See application file for complete search history.

(56) References Cited

U.S. PATENT DOCUMENTS

| | | | | |
|---|---|---|---|---|
| 4,337,016 | A | 6/1982 | Chaplin | |
| 8,360,712 | B2 * | 1/2013 | Deo | F01D 11/02 415/1 |
| 8,500,394 | B2 * | 8/2013 | Major | F01D 17/162 415/160 |
| 10,344,610 | B2 * | 7/2019 | Loiseau | F01D 25/246 |
| 2006/0083607 | A1 | 4/2006 | Synnott et al. | |
| 2011/0243725 | A1 | 10/2011 | Jones et al. | |
| 2014/0241874 | A1 | 8/2014 | Rioux | |

(Continued)

FOREIGN PATENT DOCUMENTS

| | | |
|---|---|---|
| WO | 2014052800 | 4/2014 |

OTHER PUBLICATIONS

Extended European Search Report for EP Application No. 18172301.6, dated Jul. 23, 2018.

*Primary Examiner* — Woody A Lee, Jr.
*Assistant Examiner* — Justin A Pruitt
(74) *Attorney, Agent, or Firm* — Carlson, Gaskey & Olds, P.C.

(57) ABSTRACT

A disclosed gas turbine engine includes a shroud block including a mounting slot, a blade outer air seal supported within the mounting slot and a seal disposed within the mounting slot providing a seal between the blade outer air seal and the mounting slot. An anti-rotation tab is attached to the shroud block within the mounting slot for constraining movement of the seal within the mounting slot.

15 Claims, 5 Drawing Sheets

(56) References Cited

U.S. PATENT DOCUMENTS

2016/0084099 A1* 3/2016 Davis ..... F01D 11/003
415/173.1
2016/0348523 A1 12/2016 Thomas et al.

* cited by examiner

SEAL ANTI-ROTATION

CROSS REFERENCE TO RELATED APPLICATIONS

This application claims priority to U.S. Provisional Application No. 62/506,339 filed on May 15, 2017.

BACKGROUND

A gas turbine engine typically includes a compressor section, a combustor section and a turbine section. Air entering the compressor section is compressed and delivered into the combustion section where it is mixed with fuel and ignited to generate a high-energy exhaust gas flow. The high-energy exhaust gas flow expands through the turbine section to drive the compressor and the fan section. The compressor section typically includes low and high pressure compressors, and the turbine section includes low and high pressure turbines. Components of the gas turbine engine can move axially, radially and circumferentially during engine operation. Movement of components in close proximity to each other can disrupt desired clearances and relative orientations due to loads encountered during engine operation.

SUMMARY

A gas turbine engine according to an exemplary embodiment of this disclosure, among other possible things includes a shroud block including a mounting slot, a blade outer air seal supported within the mounting slot, a seal disposed within the mounting slot providing a seal between the blade outer air seal and the mounting slot and an anti-rotation tab attached to the shroud block within the mounting slot for constraining movement of the seal within the mounting slot.

In a further embodiment of the foregoing gas turbine engine the anti-rotation tab is disposed in an upper portion of the mounting slot such that a portion of the blade outer air seal is disposed radially inward of the anti-rotation tab.

In a further embodiment of any of the foregoing gas turbine engines the anti-rotation tab is welded to the shroud block.

In a further embodiment of any of the foregoing gas turbine engines including at least one fastener securing the anti-rotation tab to the shroud block.

In a further embodiment of any of the foregoing gas turbine engines wherein the anti-rotation tab is disposed at a first end of the mounting slot, with a second end distal from the first end not including an anti-rotation tab such that the seal may be slide from the second end into abutment with the anti-rotation tab at the first end of the mounting slot.

In a further embodiment of any of the foregoing gas turbine engines further including a plurality of shroud blocks with a corresponding plurality of anti-rotation tabs disposed at the first end such that a seal disposed within a mounting slot of one shroud block is contained at a first end by an anti-rotation block disposed within one shroud block and at the second end by an anti-rotation tab disposed within a corresponding shroud block.

In a further embodiment of any of the foregoing gas turbine engines wherein the seal comprises a substantially W-shape in cross-section.

In a further embodiment of any of the foregoing gas turbine engines further including a plurality of shroud blocks disposed about a circumference of an engine axis, and corresponding plurality of blade outer air seals supported within the plurality of shroud blocks.

In a further embodiment of any of the foregoing gas turbine engines wherein the plurality of shroud blocks and blade outer air seal are disposed within a first stage of a high pressure turbine.

Another gas turbine engine according to an exemplary embodiment of this disclosure, among other possible things includes a compressor section, a combustor in fluid communication with the compressor section, a turbine section in fluid communication with the combustor, a shroud block supported within the turbine section, wherein each of the shroud block includes a mounting slot, a blade outer air seal supported within the mounting slot, a seal disposed within the mounting slot providing a seal between the blade outer air seal and the mounting slot, and an anti-rotation tab attached to the shroud block within the mounting slot for constraining movement of the seal within the mounting slot.

In a further embodiment of any of the foregoing gas turbine engines wherein the turbine section comprises a high pressure turbine and a low pressure turbine and the shroud block and blade outer air seal are disposed within a first stage of a high pressure turbine.

In a further embodiment of any of the foregoing gas turbine engines wherein the anti-rotation tab is disposed in an upper portion of the mounting slot such that a portion of the blade outer air seal is disposed radially inward of the anti-rotation tab.

In a further embodiment of any of the foregoing gas turbine engines wherein the anti-rotation tab is welded to the shroud block.

In a further embodiment of any of the foregoing gas turbine engines including at least one fastener securing the anti-rotation tab to the shroud block.

In a further embodiment of any of the foregoing gas turbine engines including a plurality of shroud blocks with a corresponding plurality of anti-rotation tabs disposed at a first end such that a seal disposed within a mounting slot of one shroud block is contained at a first end by an anti-rotation block disposed within one shroud block and at a second end by an anti-rotation tab disposed within an adjacent shroud block.

In a further embodiment of any of the foregoing gas turbine engines wherein the seal comprises a substantially W-shape in cross-section.

A method of constraining movement of a seal within a gas turbine engine according to an exemplary embodiment of this disclosure, among other possible things includes attaching an anti-rotation tab within a mounting slot of a shroud block and assembling a seal within the mounting slot such that one end of the seal abuts the anti-rotation tab.

In a further embodiment of the forgoing method, including the step of mounting a blade outer air seal within the mounting slot such that the seal is disposed between the blade outer air seal and a surface of the mounting slot.

In a further embodiment of any of the forgoing method steps including abutting a second shroud block against one side of the shroud block and limiting movement of the seal out of the a second end of the mounting slot with another anti-rotation tab disposed within a mounting sot of the second shroud block.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
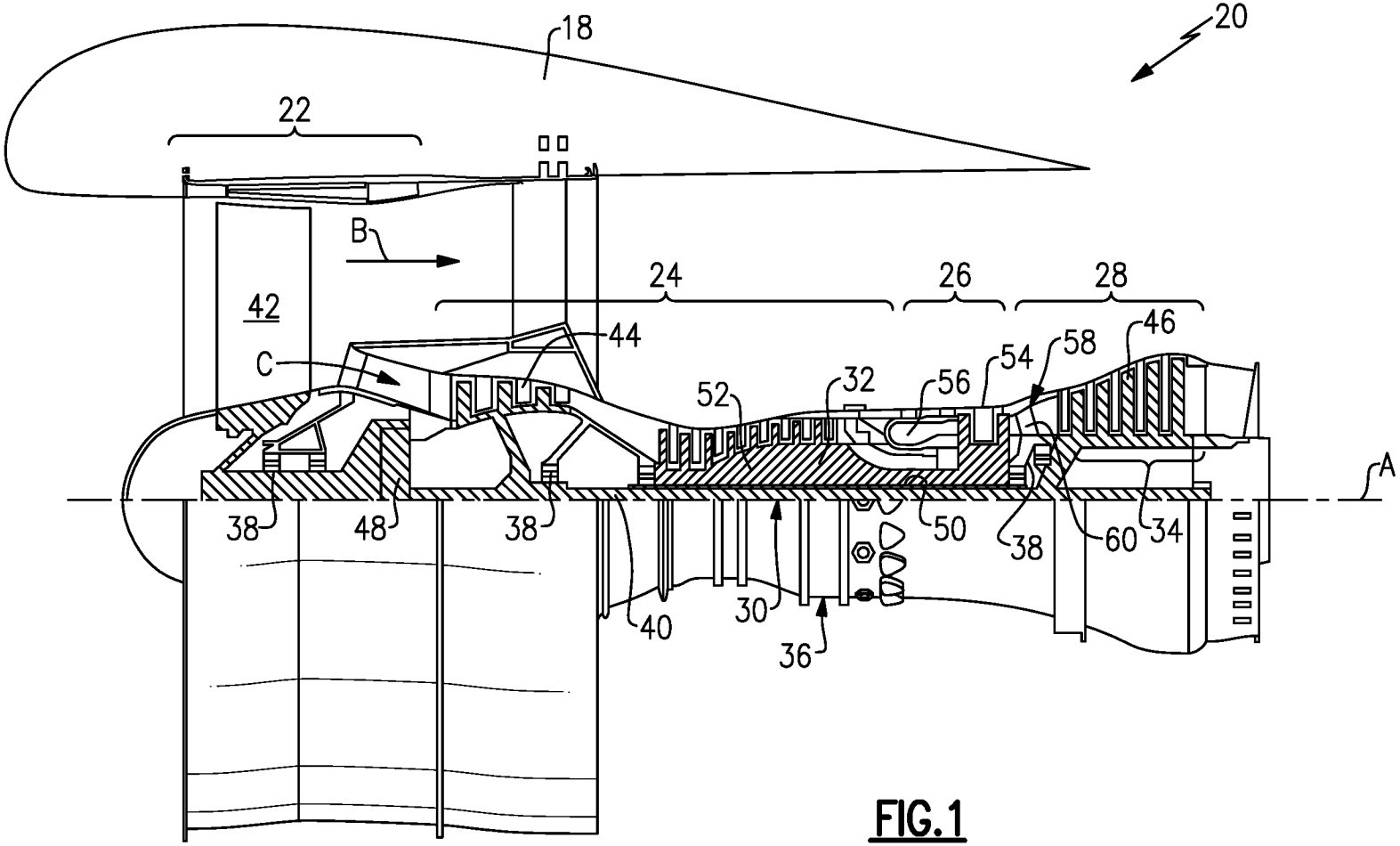
FIG. 1 schematically shows an embodiment of a gas turbine engine.

FIG. 1 schematically illustrates an example gas turbine engine 20 that includes a fan section 22, a compressor section 24, a combustor section 26 and a turbine section 28. Alternative engines might include an augmenter section (not shown) among other systems or features. The fan section 22 drives air along a bypass flow path B defined within a nacelle 18 while the compressor section 24 draws air in along a core flow path C where air is compressed and communicated to a combustor section 26. In the combustor section 26, air is mixed with fuel and ignited to generate a high-energy exhaust gas stream that expands through the turbine section 28 where energy is extracted and utilized to drive the fan section 22 and the compressor section 24.

Although the disclosed non-limiting embodiment depicts a two-spool turbofan gas turbine engine, it should be understood that the concepts described herein are not limited to use with two-spool turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high-speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 58 of the engine static structure 36 is arranged generally between the high pressure turbine 54 and the low pressure turbine 46. The mid-turbine frame 58 further supports bearing systems 38 in the turbine section 28 as well as setting airflow entering the low pressure turbine 46.

Airflow through the core airflow path C is compressed by the low pressure compressor 44 then by the high pressure compressor 52 mixed with fuel and ignited in the combustor 56 to produce high-energy exhaust gases that are then expanded through the high pressure turbine 54 and low pressure turbine 46. The mid-turbine frame 58 includes vanes 60, which are in the core airflow path and function as an inlet guide vane for the low pressure turbine 46. Utilizing the vane 60 of the mid-turbine frame 58 as the inlet guide vane for low pressure turbine 46 decreases the length of the low pressure turbine 46 without increasing the axial length of the mid-turbine frame 58. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV")

system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of $[(\text{Tram °R})/(518.7\text{°R})]^{0.5}$. The "Low corrected fan tip speed", as disclosed herein according to one non-limiting embodiment, is less than about 1150 ft/second.

The example gas turbine engine includes the fan 42 that comprises in one non-limiting embodiment less than about 26 fan blades. In another non-limiting embodiment, the fan section 22 includes less than about 20 fan blades. Moreover, in one disclosed embodiment the low pressure turbine 46 includes no more than about 6 turbine rotors schematically indicated at 34. In another non-limiting example embodiment the low pressure turbine 46 includes about 3 turbine rotors. A ratio between the number of fan blades 42 and the number of low pressure turbine rotors is between about 3.3 and about 8.6. The example low pressure turbine 46 provides the driving power to rotate the fan section 22 and therefore the relationship between the number of turbine rotors 34 in the low pressure turbine 46 and the number of blades 42 in the fan section 22 disclose an example gas turbine engine 20 with increased power transfer efficiency.

Figure 2:
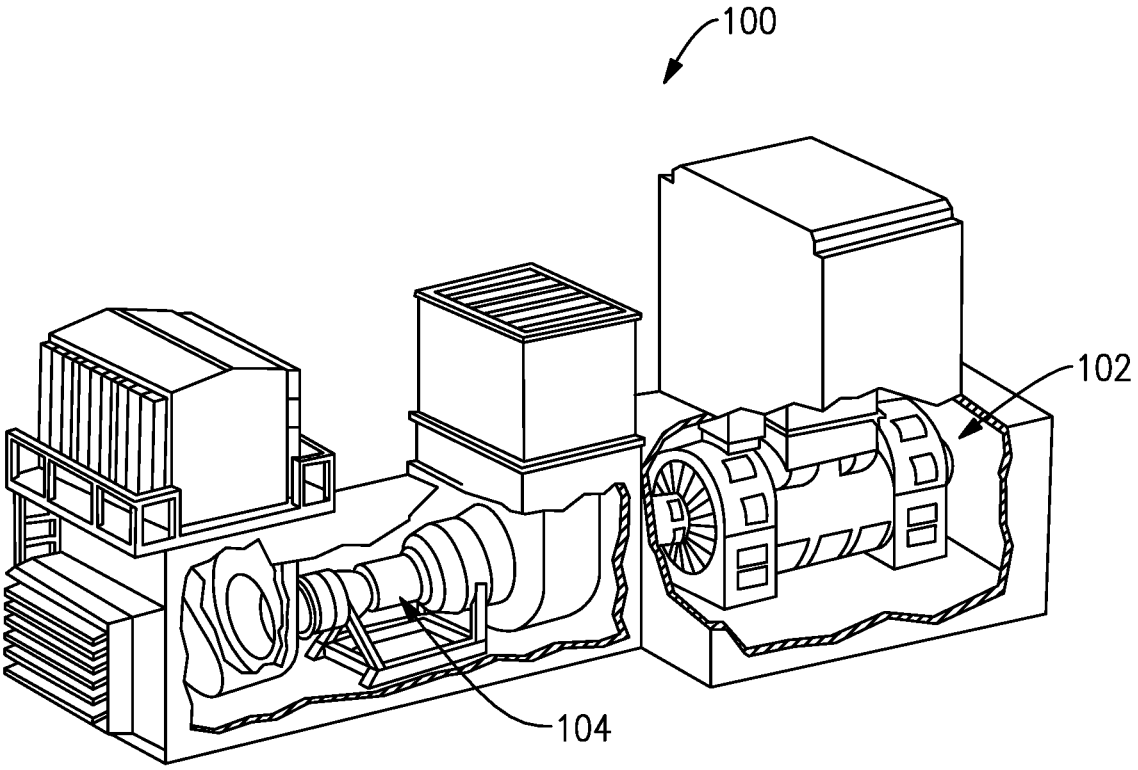
FIG. 2 schematically shows an embodiment of an industrial gas turbine engine assembly.

Referring to FIG. 2, an example industrial gas turbine engine assembly 100 includes a gas turbine engine 104 that is mounted to a structural land based frame to drive a generator 102. The example gas turbine engine 104 includes many of the same features described in the gas turbine engine 20 illustrated in FIG. 1 and operates in much the same way. The land based industrial gas turbine engine 100, however, may include additional features such as a shaft to drive the generator 102 and is not constrained by the same weight restrictions that apply to an aircraft mounted gas turbine engine. As appreciated, many of the parts that are utilized in an aircraft and land based gas turbine engine are common and therefore both aircraft based and land based gas turbine engines are within the contemplation of this disclosure.

Figure 3:
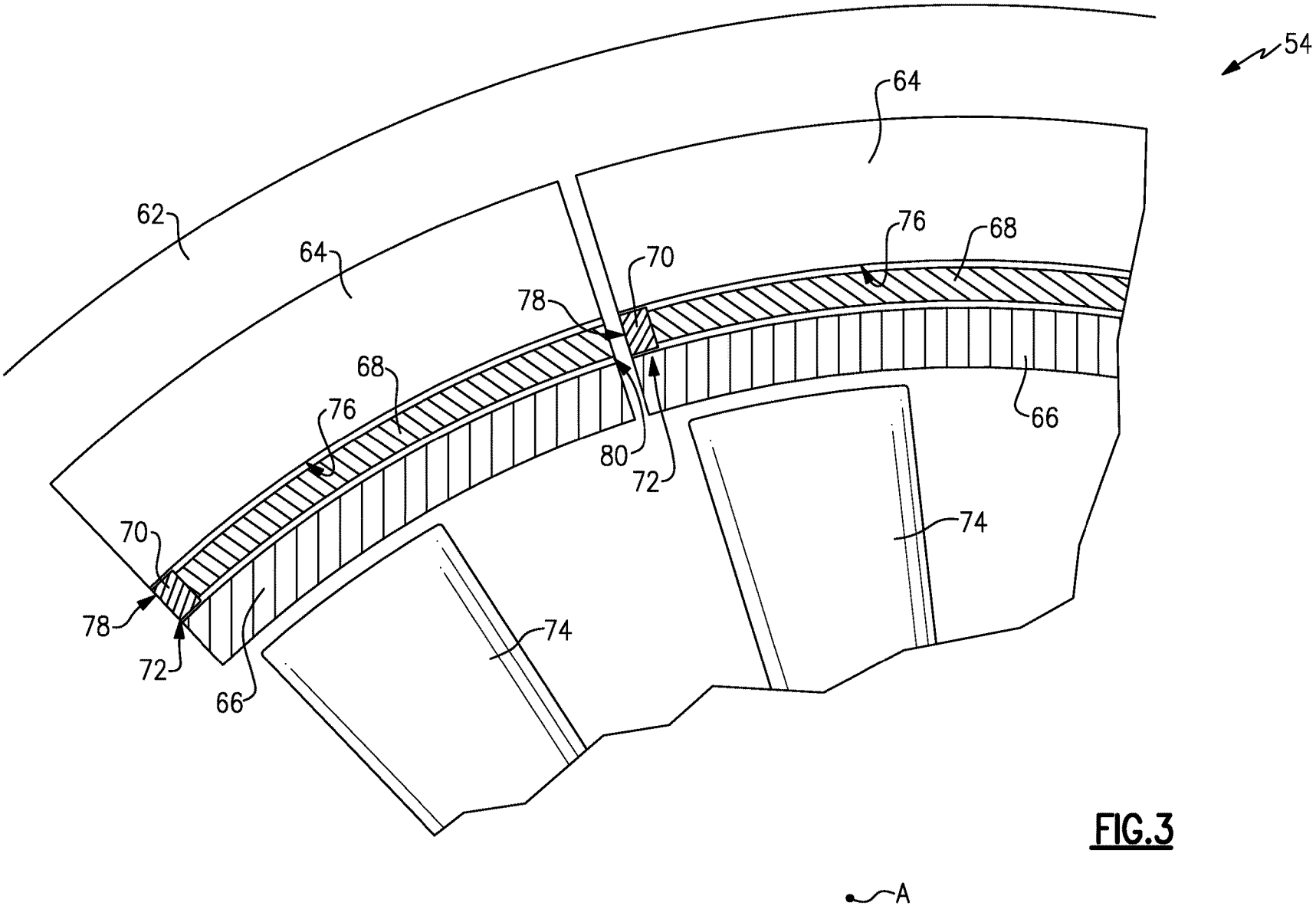
FIG. 3 is a schematic axial view of an embodiment of an example gas turbine engine.

Referring to FIG. 3 with continued reference to FIG. 1, the high pressure turbine 54 includes a first stage schematically shown in FIG. 3. The first stage includes shroud blocks 64 supported within a case 62. A plurality of shroud blocks 64 are disposed circumferentially about the engine axis A and support a corresponding plurality of blade outer air seals (BOAS) 66. Each of the shroud blocks 64 include a mounting slot 72. A seal 68 is disposed within each slot 72 to provide a seal between the BOAS 66 and a surface 76 of the mounting slot 72. An anti-rotation tab 70 is attached at a first end 78 of the mounting slot 72. A second end 80 of each mounting slot 72 is open to enable installation of the seal 68. The BOAS 66 define a gas path surface radially outside and proximate to a turbine blade 74. Although, the disclosed example shroud block 64 and BOAS 66 are disposed within a first stage of the high pressure turbine, other locations including a seal within a circumferential slot would benefit from this disclosure and is within the contemplation of this disclosure.

Figure 4:
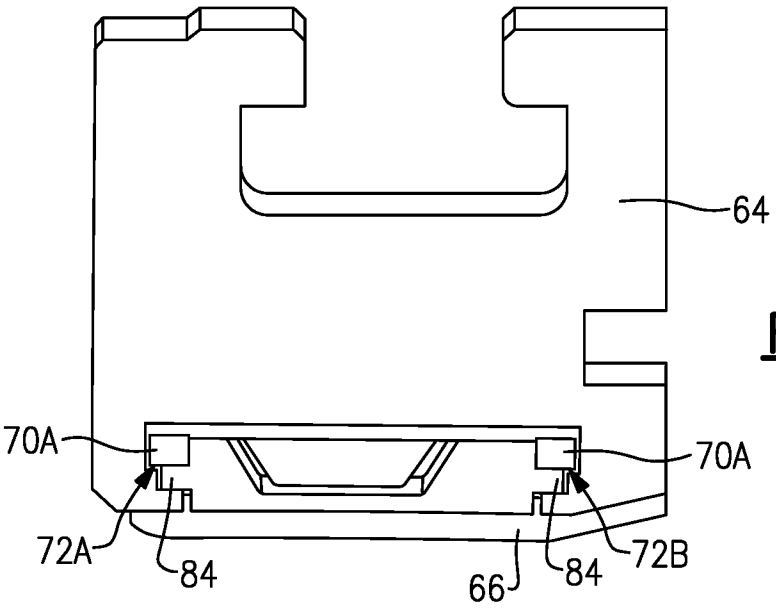
FIG. 4 is a circumferential view of a portion of the example engine turbine section.
Figure 5:
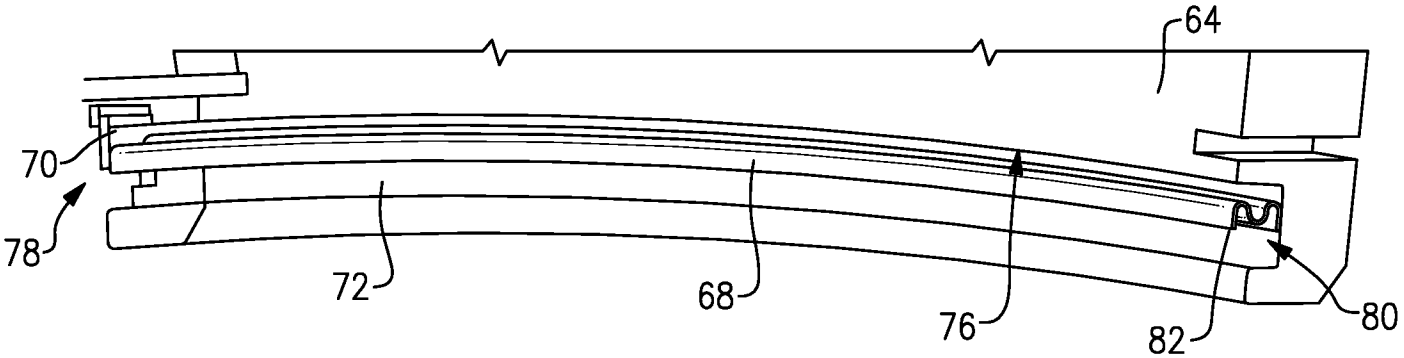
FIG. 5 is an axial view of a portion of the example engine turbine section.

Referring to FIGS. 4 and 5 with continued reference to FIG. 3, the example shroud block 64 includes a forward mounting slot 72A and an aft mounting slot 72B that receives corresponding feet 84 of the BOAS 66. FIG. 3 shows the first end 78 of the mounting slots 72A-B and therefore forward and aft anti-rotation tabs 70A-B. The seal 68 is contained circumferentially within each corresponding mounting slot 72A-B by the corresponding anti-rotation tabs 70A-B.

As is show in FIG. 5, a second end 80 of each mounting slot 72A-B is open and enables assembly and removal of the seal 68 without the need to remove the anti-rotation tab 70A-B. In the disclosed embodiment, the seal 68 includes a substantially W-shape in cross-section as indicated at 82.

Figure 7:
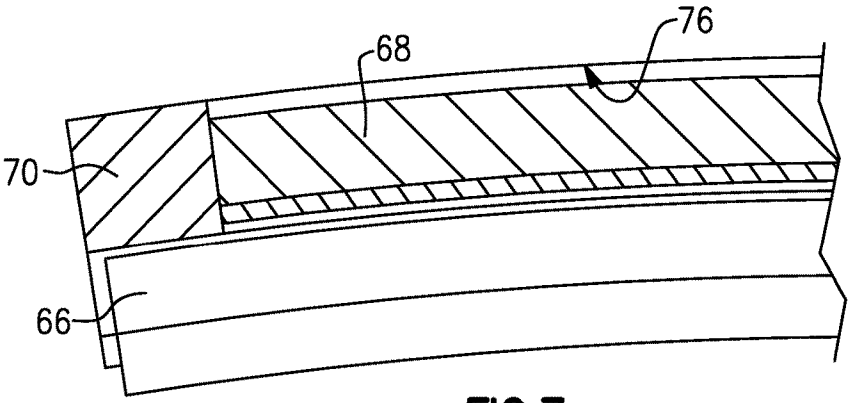
FIG. 7 is an enlarged axial view of an example seal anti-rotation tab embodiment.
Figure 6:
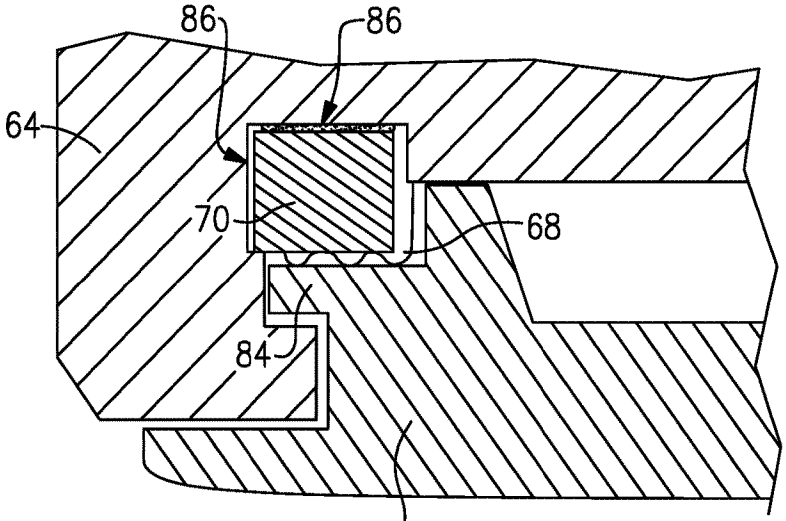
FIG. 6 is an enlarged circumferential view of an example seal anti-rotation tab embodiment.

Referring to FIGS. 6 and 7, an enlarged view of the first end 78 of the mounting slot 72 shows the anti-rotation tabs 70A-B are attached by a weld indicated at 86. The mounting slot 72 is sized to accept both the seal 68 and the feet 84. The feet 84 are disposed radially inward of the anti-rotation tabs 70A-B. The seal 68 is within the mounting slot 72 between the BOAS 66 and the radially outer surface 76 of shroud block 64.

Figure 8:
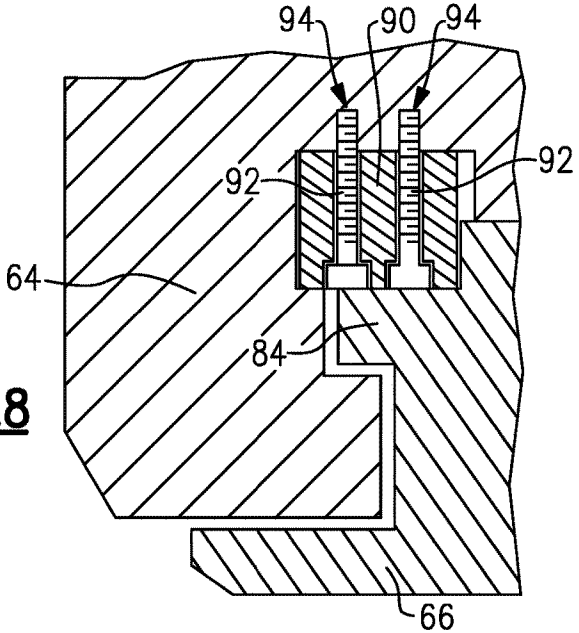
FIG. 8 is an enlarged circumferential view of another example seal anti-rotation tab embodiment.

Referring to FIG. 8, another example anti-rotation tab 90 is shown and includes fasteners 92 for securement to the shroud block 64. In the disclosed example, the shroud block 64 includes threaded holes 94 that receive the threaded fasteners 92. It should be appreciated that the anti-rotation tabs 70, 90 may be secured to the shroud block 64 according to other know methods and that such methods and means are within the contemplation of this disclosure.

The disclosed anti-rotation tabs 70, 90 prevent circumferential movement of the seals 68 while including an open side to enable assembly and removal without the need to remove the anti-rotation tabs.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A gas turbine engine comprising:

a plurality of shroud blocks each including a mounting slot;

a blade outer air seal supported within the mounting slot;

a seal disposed within the mounting slot providing a seal between the blade outer air seal and the mounting slot; and a plurality of anti-rotation tabs, each of the plurality of anti-rotation tabs attached to a corresponding one of the plurality of shroud blocks within the mounting slot for constraining movement of the seal within the mounting slot, wherein the anti-rotation tab is disposed at a first end of the mounting slot, with a second end distal from the first end not including an anti-rotation tab such that the seal may be slid from the second end into abutment with the anti-rotation tab at the first end of the mounting slot such that a seal disposed within a mounting slot of one shroud block is contained at a first end by an anti-rotation tab disposed within the one shroud block and at the second end by an anti-rotation tab disposed within an adjacent shroud block.

2. The gas turbine engine as recited in claim 1, wherein the anti-rotation tab is disposed in an upper portion of the mounting slot such that a portion of the blade outer air seal is disposed radially inward of the anti-rotation tab.

3. The gas turbine engine as recited in claim 2, wherein the anti-rotation tab is welded to the shroud block.

4. The gas turbine engine as recited in claim 2, including at least one fastener securing the anti-rotation tab to the shroud block.

5. The gas turbine engine as recited in claim 1, wherein the seal comprises a substantially W-shape in cross-section.

6. The gas turbine engine as recited in claim 1, including a plurality of shroud blocks disposed about a circumference of an engine axis, and corresponding plurality of blade outer air seals supported within the plurality of shroud blocks.

7. The gas turbine engine as recited in claim 6, wherein the plurality of shroud blocks and blade outer air seal are disposed within a first stage of a high pressure turbine.

8. A gas turbine engine comprising;

a compressor section;

a combustor in fluid communication with the compressor section;

a turbine section in fluid communication with the combustor;

a plurality of shroud blocks supported within the turbine section, wherein each of the plurality of shroud blocks includes a mounting slot;

a blade outer air seal supported within the mounting slot of each of the plurality of shroud blocks;

a seal disposed within the mounting slot providing a seal between the blade outer air seal and the mounting slot; and a plurality of anti-rotation tabs, each of the plurality of anti-rotation tabs attached to a corresponding one of the plurality of shroud blocks within the mounting slot for constraining movement of the seal within the mounting slot, wherein the anti-rotation tab is disposed at a first end of the mounting slot, with a second end distal from the first end not including an anti-rotation tab such that the seal may be slid from the second end into abutment with the anti-rotation tab at the first end of the mounting slot such that a seal disposed within a mounting slot of one shroud block is contained at a first end by an anti-rotation block disposed within the one shroud block and at the second end by an anti-rotation tab disposed within an adjacent shroud block.

9. The gas turbine engine as recited in claim 8, wherein the turbine section comprises a high pressure turbine and a low pressure turbine and the shroud block and blade outer air seal are disposed within a first stage of a high pressure turbine.

10. The gas turbine engine as recited in claim 8, wherein the anti-rotation tab is disposed in an upper portion of the mounting slot such that a portion of the blade outer air seal is disposed radially inward of the anti-rotation tab.

11. The gas turbine engine as recited in claim 8, wherein the anti-rotation tab is welded to the shroud block.

12. The gas turbine engine as recited in claim 8, including at least one fastener securing the anti-rotation tab to the shroud block.

13. The gas turbine engine as recited in claim 8, wherein the seal comprises a substantially W-shape in cross-section.

14. A method of constraining movement of a seal within a gas turbine engine comprising;

attaching an anti-rotation tab within a mounting slot of each of a plurality of shroud blocks;

assembling a seal within the mounting slot of each of the plurality of shroud blocks such that one end of the seal abuts the anti-rotation tab; and abutting a second shroud block against one side of each of the plurality of shroud blocks and limiting movement of the seal out of a second end of the mounting slot with another anti-rotation tab disposed within a mounting slot of an adjacent one of the plurality of shroud blocks.

15. The method as recited in claim 14, including mounting a blade outer air seal within the mounting slot such that the seal is disposed between the blade outer air seal and a surface of the mounting slot.

* * * * *